United States Patent [19]

Daly et al.

[11] Patent Number: 4,682,663

[45] Date of Patent: Jul. 28, 1987

[54] MOUNTING MEANS FOR CUTTING ELEMENTS IN DRAG TYPE ROTARY DRILL BIT

[75] Inventors: Jeffery E. Daly, Cypress; Percy W. Schumacher, Houston, both of Tex.

[73] Assignee: Reed Tool Company, Houston, Tex.

[21] Appl. No.: 830,399

[22] Filed: Feb. 18, 1986

[51] Int. Cl.[4] ..... E21B 10/46

[52] U.S. Cl. ..... 175/329; 175/410; 408/144; 408/145

[58] Field of Search ..... 408/144, 145; 407/57, 407/118, 119; 175/329, 373, 374, 410

[56] References Cited

U.S. PATENT DOCUMENTS

| | | | |
|---|---|---|---|
| 4,156,329 | 5/1979 | Daniels et al. | 175/329 |
| 4,225,322 | 9/1980 | Knemeyer | 175/329 |
| 4,303,136 | 12/1981 | Ball | 175/329 |
| 4,429,755 | 2/1984 | Williamson | 175/329 |
| 4,440,246 | 4/1984 | Jurgens | 175/329 |
| 4,442,909 | 4/1984 | Radtke | 175/329 |
| 4,452,324 | 6/1984 | Jurgens | 175/393 |
| 4,499,958 | 2/1985 | Radtke et al. | 175/329 |
| 4,505,342 | 3/1985 | Barr et al. | 175/410 |
| 4,533,004 | 8/1985 | Ecer | 175/329 |

FOREIGN PATENT DOCUMENTS

| | | | |
|---|---|---|---|
| 117241 | 8/1984 | European Pat. Off. | 175/329 |
| 155026 | 9/1985 | European Pat. Off. | 175/329 |

*Primary Examiner*—Z. R. Bilinsky
*Attorney, Agent, or Firm*—Vinson & Elkins

[57] ABSTRACT

A drag type rotary drill bit (10) having mounted on its lower face (22) a rigid integral holder (30) for a plurality of polycrystalline diamond compact (PDC) cutting elements (42) secured to a planar face (60) of the holder (30). An upper projecting tapered end portion (71) of the holder (30) defines tapered surfaces (72, 73) with the lower tapered surface (72) extending at a relatively large clearance angle (B) to provide a relatively small wear flat surface on the holder (30).

13 Claims, 12 Drawing Figures

MOUNTING MEANS FOR CUTTING ELEMENTS IN DRAG TYPE ROTARY DRILL BIT

BACKGROUND OF THE INVENTION

This invention relates to a rigid holder for mounting a plurality of cutting elements in a drag type rotary drill bit, and more particularly to a rigid integral holder or carrier for a plurality of polycrystalline diamond compact (PDC) cutting elements mounted on a unitary holder which is secured directly to the exterior face of the drill bit.

Heretofore, drag type rotary drill bits have been provided with a plurality of separate polycrystalline diamond compact (PDC) cutting elements, but normally each PDC cutting element has been mounted on a separate stud secured to a separate blade or secured within pockets formed directly on the exterior of the drill bit, such as, for example, by brazing, welding, or press fitting within a recess in the face of the bit. In some instances, separate PDC cutting elements without studs have been mounted directly on the drill bit face.

The two main bit problems encountered in drilling which tend to result in decreased penetration of a formation are deterioration or wear of the cutting elements resulting primarily from heat degradation, and "balling" of the bit face. "Balling" or sticking is caused by a sticky formation, such as sticky shales or similar formations having a large percentage of clays, adhering to the cutting face of the bit. This may occur in certain formations where the hydraulic action of drilling mud is inadequate, or where hydraulic passages in the bit may be poorly designed and result in an inefficient flow of mud across the face of the bit. It is noted that for drilling offshore the continental United States, water base muds are normally employed as government regulations generally render the use of oil base muds cost prohibitive. The use of water base muds may result in substantial "balling", particularly when drilling in sticky shales or similar formations.

It is noted that a worn PDC type bit normally forms wear flat surfaces adjacent the diamond cutting edges of the cutting elements and this causes a reduction in the penetration rate of the bit as the cutting edges do not penetrate as deeply into the formation. As the cutting elements wear, increasingly larger wear flats are formed adjacent the cutting edges. The increased size wear flats require an increasingly higher weight on the bit to maintain a constant rate of penetration into the formation thereby resulting in a higher torque requirement for rotating the bit and in a higher heat generated in the cutting elements.

The stud or support on which the PDC cutting element is mounted sometimes fractures or shears upon continued use, such as when the bit is suddenly pulled off-bottom, or if a bit bounce occurs. The cutting elements are susceptible to thermal shock as a result of rapid cooling by water or drilling mud in addition to unfavorable temperature gradients that develop combined with the sudden removal of the compressive stresses due to bit weight. This causes tension on the supports for the cutting elements. It is noted that the compressive and tensile stresses throughout the cutting elements and their supports are significantly increased under conditions in which the wear flat temperatures are around three hundred and fifty (350) degrees Centigrade. This, of course, increases the possibility of shearing or breakage of the support studs on which the PDC cutting elements are mounted. Also, the greater the projection of the support for the PDC cutting elements from the adjacent face of the drill bit, the greater the amount of stress provided on the supports from the cutting action which likewise will increase the possibility of breakage or shearing of the supports for the PDC cutting elements.

It has been found that the cutting element develops a significant wear flat by the time fifty percent (50%) of its useful life has been expended. Thus, PDC cutting elements should be designed to provide a minimal wear flat for effective operation. To maximize the life of a PDC cutting element, the rotary drill bit should be operated under conditions so that thermally accelerated wear does not occur and to reduce such wear, the rotary drill bit should be operated at a rotary speed and bit weight which does not cause the thermal wear effects to become critical at over around three hundred and fifty (350) degrees Centigrade.

Heretofore, blades have been provided on some drag type rotary drill bits having a plurality of PDC cutting elements thereon. For example, U.S. Pat. No. 4,499,958 dated Feb. 19, 1985, shows a drag type rotary drill bit with a plurality of cutting blades welded to the face of the drill bit with each cutting blade having a plurality of studs mounted thereon, each stud having a PDC cutting element on its projecting end. However, the studs are spaced a substantial distance from each other along the length of the cutting blade and each stud or support has only a single PDC cutting element thereon.

Also, U.S. Pat. No. 4,440,246 dated Apr. 3, 1984 shows a rotary drill bit with a wedge-shaped cutting member defining two PDC cutting faces formed from cutting elements extending generally at right angles to each other and mounted on a stud or carrier member secured to the bit body for providing a ploughing action against the formation.

Various other references, such as exemplified by U.S. Pat. No. 4,429,755 dated Feb. 7, 1984, show drag type rotary drill bits with stud mounted PDC cutting elements projecting from the outer face of the drill bits and arranged in various patterns on the face of the drill bit. The studs are normally secured on the face of the drill bit by brazing, welding, or press fitted within openings or recesses along the face. Various types of nozzles for drag type drill bits are illustrated in U.S. Pat. Nos. 4,303,136 dated Dec. 1, 1981 and 4,452,324 dated June 5, 1984.

SUMMARY OF THE INVENTION

This invention is directed to drag type rotary drill bit having polycrystalline diamond compact (PDC) cutting elements similar to the Stratapax type manufactured by the General Electric Company and described in Daniels, et al. U.S. Pat. No. 4,156,329 dated May 29, 1979 and Knemeyer U.S. Pat. No. 4,225,322 dated Sept. 30, 1980, and more particularly to means for mounting such PDC cutting elements on the drill bit. The Stratapax type cutting element has an outer thin diamond layer secured to a hard carbide metal substrate or base. The outer diamond layer defines a planar cutting face and cutting edge secured to the hard metal base which has a rear support face secured, such as by brazing, to a support projecting from the face of the drill bit. Such Stratapax type cutting elements are in wide commercial usage. The term "polycrystalline diamond" or "PDC" cutting elements as used in the specification and claims herein shall be interpreted as included all diamond or diamond-like cutting elements having a hardness generally similar to the hardness of a natural diamond.

In the present invention, the mounting means for the PDC cutting elements comprises an elongated rigid support body or holder for two or more PDC cutting elements of the Stratapax type extending in a radial direction with respect to the axis of rotation of the drill bit. The elongated unitary holder or block support has a base portion secured or mounted on the outer face of the drag type drill bit by suitable securing means, such as by welding, brazing, or press fitting within a recess or opening in the face, and a projecting end portion extending from the base portion having the cutting elements thereon for engaging a formation in cutting relation.

The utilization of a single support body or holder for two or more Stratapax type PDC cutting elements extending in a radial direction with respect to the axis of rotation of the drill bit and with the cutting faces being in a common plane has several advantages. First, as a result of a PDC support having a solid block metal base portion of an increased cross section, an increased strength is provided which minimizes breaking or shearing of the support. Also, as a result of the increased strength of the support, the projecting end portion of the support may extend further from the face of the drill bit than heretofore, thereby to reduce a tendency for balling of the drill bit from sticky formations. The increased strength of the PDC support permits a tapering of the projecting end portion of the support with a steep backside rake, thereby providing a minimal rubbing contact or wear flat surface adjacent the cutting edges of the cutting elements, particularly upon wear of the cutting edges. The relatively small wear flat surfaces adjacent the cutting edges results in relatively sharp cutting edges which maximize the rate of penetration for the cutting elements. A minimal wear flat surface is maintained during wear of the cutting elements as the tapered supporting back side extends for the entire extent of the cutting elements. Thus, it is important for maximizing the rate of penetration that a minimal wear flat surface be provided at all times.

Drilling fluids discharged from nozzles aid in cooling the cutting elements, as well as aiding in removing the chips or rock cuttings in front of the cutting elements when the jet or spray is directed in advance of the cutting elements. The discharge nozzles may be positioned at various locations and provided in a variety of different embodiments, such as having a discharge opening of an elongate or oval shape so that the fluid is directed against a plurality of the cutting elements for washing over the cutting elements in advance of the cutting operation, or for directing the fluid directly in the formation.

It is an object of this invention to provide a drag type rotary drill bit having a plurality of adjacent polycrystalline diamond compact (PDC) cutting elements of the Stratapax type mounted on a unitary rigid support and extending in a common plane generally radially of the axis of rotation of the bit.

An additional object of this invention is to provide such a rotary drill bit in which the plurality of PDC cutting elements are mounted on a unitary elongated holder and project a maximum distance from the adjacent face of the drill bit.

It is a further object of this invention to provide mounting means for a plurality of PDC cutting elements on a drag type rotary drill bit with the mounting means formed of a sintered tungsten carbide metal and having a tapered end portion projecting from the face of the bit and terminating adjacent the cutting elements, thereby to provide a minimal wear flat surface adjacent the cutting elements upon wear thereof.

Other objects, features, and advantages of this invention will become more apparent after referring to the following specification and drawings.

DESCRIPTION OF THE INVENTION

Figure 2:
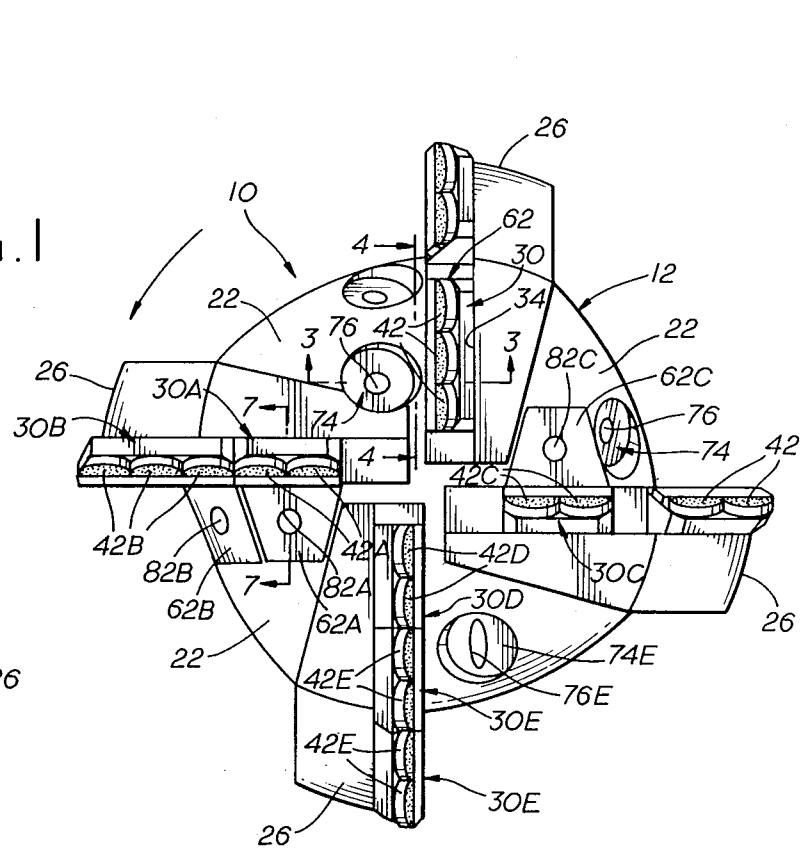
FIG. 2 is a bottom plan of the drag type drill bit shown in FIG. 1 showing the PDC cutting elements and associated mounting means forming the present invention arranged in different patterns on the outer face of the drill bit body.
Figure 1:
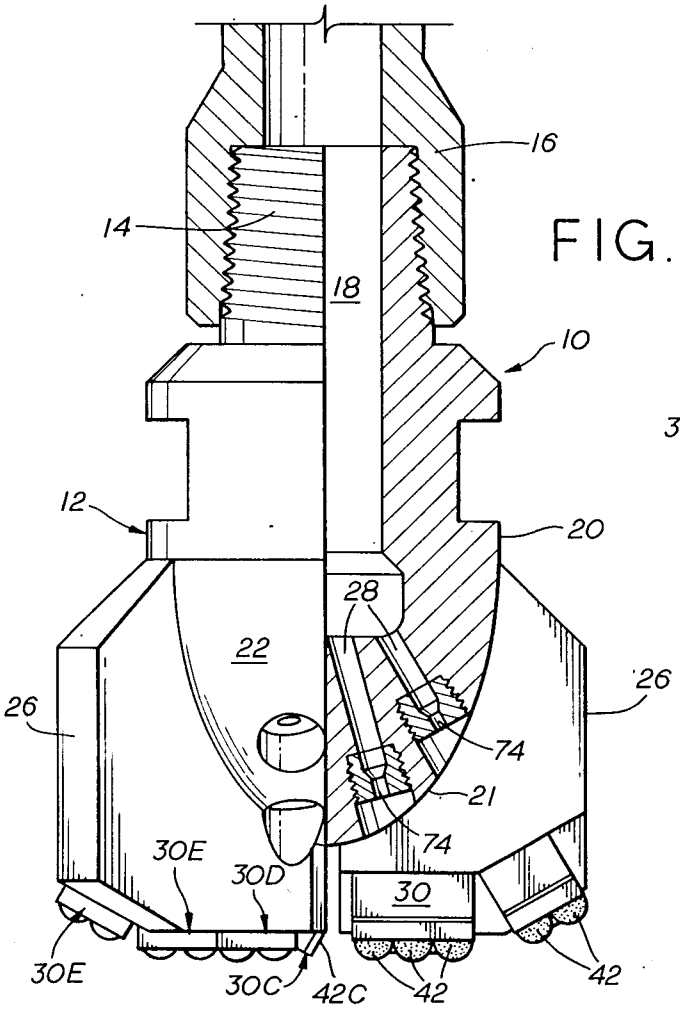
FIG. 1 is an elevational view, partly in section, showing a drag type rotary drill bit having means for mounting PDC cutting elements forming this invention thereon.

Referring particularly to FIGS. 1 and 2, a drag type rotary drill bit is shown generally at 10 having a generally cylindrical bit body 12 with an externally threaded pin 14 at its upper end. Pin 14 is threaded within the lower end of a drill string indicated generally at 16 which is suspended from a drill rig at the surface for rotating drill bit 10. Drill bit body 12 has a longitudinally extending main fluid passage 18 which is adapted to receive drilling mud or fluid from the drill rig for the drilling operation.

Bit body 12 has an outer peripheral surface 20 with a lower tapered end 21 forming a lower face 22 having projections 26 thereon. An auxiliary flow passage 28 is in fluid communication with main flow passage 18 and receives drilling fluid therefrom for discharge as will be explained. Bit body 12 defines suitable flow passages thereabout for flow of the discharged drilling fluid with cuttings and the like. It is to be understood that bit body 12 can be formed of various shapes or designs depending, for example, on such factors as the type of formation, the type of cutting elements employed, and the mud program proposed, for example. Bit body 12 may be formed of any suitable material, such as various types of steels, or infiltrated tungsten carbide.

Referring to FIG. 2, the PDC cutting elements are shown arranged in different patterns on lower face 22 of drill bit 10 for the purposes of illustration with each support or holder shown at 30, 30A, 30B, 30C, 30D, and 30E mounting at least two PDC cutting elements. Holder or carrier 30 is specifically illustrated in FIGS. 3–6 and will be described in detail, it being understood that holders 30A through 30E are generally similar to holder 30 except as further illustrated.

Projection 26 on drill bit body 12 as shown on FIGS. 3–6 forms an abutting planar surface at 34 facing the direction of rotation of drill bit 10 and an adjacent bit surface 36 extending in a generally transverse direction to surface 34. Surface 34 is connected by an inclined surface 38 to bit surface 22 to form a continuation of surface 22. Holder 30 is brazed to projection 26 along surfaces 34 and 36 and at 40. Holder 30 has three PDC cutting elements thereon indicated generally at 42. Each cutting element 42 is identical and forms a solid semicircular element having parallel planar end faces 44 and 46 connected by an outer arcuate peripheral surface 48 extending generally at right angles to planar end faces 44 and 46. Each cutting element 42 includes an outer thin diamond layer 52 defining end face 44 which forms the planar cutting face and an arcuate cutting edge 54. Diamond layer 52 is suitably secured such as by sintering to a tungsten carbide base 56 which defines end face 46. A separate hard carbide strip 57 is brazed at 58 to an inclined support face 60 on holder 30 and defines an upper supporting edge 61 which contacts the lower edge 63 of semicircular cutting element 42 for rigidity and support. End face 46 is also brazed to support face 46. While the thin diamond layer 52 is preferably formed of a polycrystalline (man-made) diamond structure, it may be formed of other materials, such as, for example, ceramics, or cubic boron nitride.

While cutting element 42 is preferably of a semicircular shape of the Stratapax type manufactured by the General Electric Company, it is to be understood that cutting element 42 may be of different shapes to define a suitable cutting face and cutting edge for engaging a formation to be bored or cut, such as, for example, a circular shape.

Holder 30 is an integral solid elongate block body 62 formed preferably of a sintered tungsten carbide material. Elongate block body 62 extends in a radial direction with respect to the axis of rotation of bit 10 and has generally parallel ends 66 connected by generally parallel respective front and rear sides 67 and 68. As shown particularly in FIGS. 3 and 4, body 62 has a lower base portion 70 and an outwardly projecting tapered end portion 71.

Cutting edge 54 is defined primarily by peripheral surface 48 which extends at right angles to outer cutting face 44. Cutting element 42 has a negative rake as measured by the clearance angle A in FIG. 3 of around twenty degrees (20°) with respect to the adjacent surface of formation F being cut. Tapered end portion 71 defines tapered surfaces 72 and 73. Upper tapered surface 73 forms a continuation of upper peripheral surface 48 of cutting element 42 and extends at a clearance angle A which is the same as the angularity of the negative rake in the unworn condition of cutting element 42. Surface 73 preferably has a width generally similar to the thickness of cutting element 42 and the width of surface 48.

Figure 5:
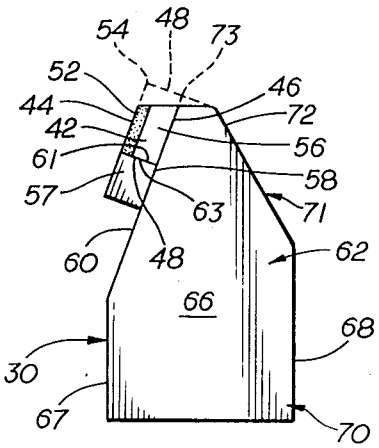
FIG. 5 is a side elevation of the holder of FIG. 4 with a plurality of PDC cutting elements secured therein removed from the face of the rotary drill bit body.
Figure 3:
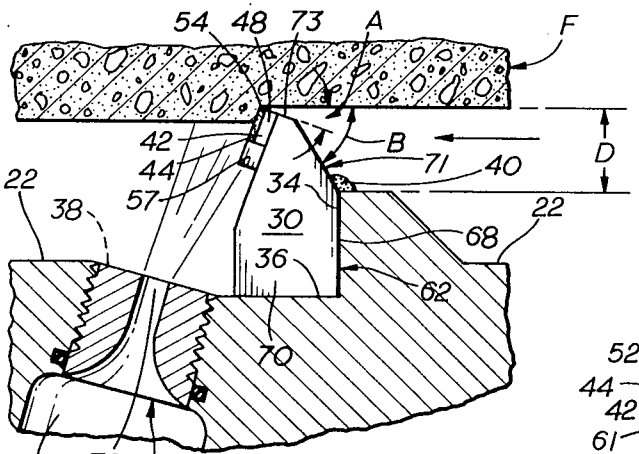
FIG. 3 is a section taken generally along the line 3—3 of FIG. 2 showing a holder or support on the drill bit body mounting a plurality of Stratapax type PDC cutting elements thereon and a discharge nozzle on the bit body adjacent the support.
Figure 4:
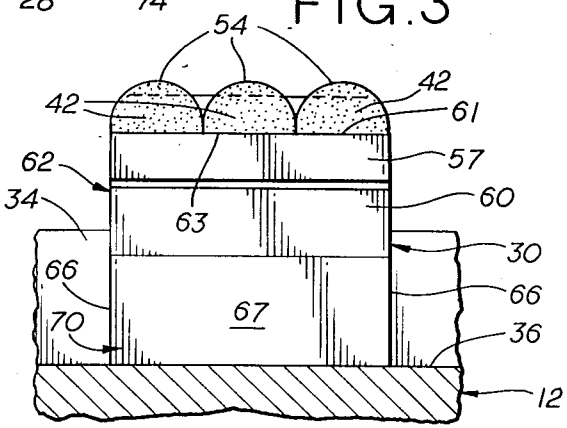
FIG. 4 is a section taken generally along the line 4—4 of FIG. 2 and showing the holder of FIGS. 2 and 3 in front elevation with the cutting faces of the cutting elements illustrated.

Tapered surface 72 is positioned at a clearance angle B with respect to the surface of formation F being cut as shown in FIG. 3 which is substantially greater than the negative rake angle A and this provides the relatively small wear surface generated after substantial wear as illustrated in FIG. 5. Angle B is preferably around forty-five degrees (45°) and would function satisfactorily under certain conditions as an angle between around thirty degrees (30°) and sixty-five degrees (65°). Upon wear of cutting elements 42 as shown particularly in FIG. 5, a relatively small wear flat area or surface is provided for contacting formation F during the cutting operation. This results in a minimum of rubbing friction between cutting elements 42 upon rotation of drill bit 10 and likewise results in a minimum of heat generated by such rubbing friction, particularly upon the utilization of a worn bit.

Elongated holder 30 provides strength to the plurality of cutting elements 42. It is noted that a maximum stress resulting from the cutting operation is not normally exerted against all of the cutting elements 42 in holder 30 simultaneously. Thus, if only a single cutting element 42 is exposed to maximum stress at any one time, the residual strength of the adjacent portions of holder 30 may be utilized by the cutting element having such maximum stress. Thus, by providing holder 30 with a plurality of cutting elements 42, breakage or shearing of holder 30 is minimized.

Further, as a result of such strength, holder 30 may project a maximum distance from the adjacent bit surface 22 such as illustrated at D in FIG. 3. As an example, projection D may preferably be between one and two times the radius of cutting elements 42. Holder 30 may be formed of tungsten carbide having a Rockwell A hardness of eighty to ninety-five (80–95) and a stiffness as measured by Young's modulus of elasticity of sixty to ninety million pounds per square inch (psi). Such a holder 30 has been found to provide the necessary strength utilizing a tapered projecting end portion 71 as shown.

An externally threaded fluid discharge nozzle is indicated generally at 74 and is threaded within an opening leading to auxiliary fluid passage 28 in fluid communication with main flow passage 18. Discharge nozzle 74 is positioned within inclined surface 38 and has an elongate or oval discharge opening 76 arranged at an angle with respect to bit surface 22 to provide a relatively long jet or stream directed against the formation in advance of cutting elements 42. The discharged fluid also washes against the faces 44 of cutting elements 42 and tends to remove cuttings or the like from the formation prior to the cutting action of the cutting elements 42. The discharged fluid further cools the cutting elements 42 secured within holder 62.

Figure 12:
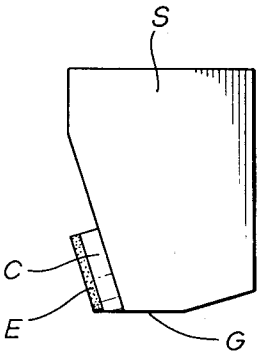
FIG. 12 (PRIOR ART)
FIG. 12 is a view of the prior art cutting element of FIG. 10 illustrated in a worn condition with a wear flat surface provided adjacent the cutting edge of the PDC cutting element.
Figure 11:
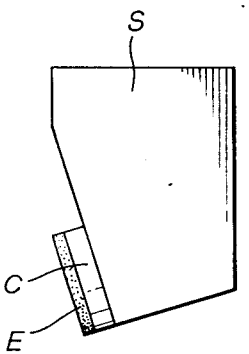
FIG. 11 (PRIOR ART)
FIG. 11 is an example of a prior art PDC cutting element which shows a new PDC cutting element with a sharp cutting edge.

As an indication of prior art, reference is made to FIGS. 11 and 12 in which the prior art cutter has a stud S with a PDC cutting element C thereon providing a cutting edge E. FIG. 11 shows cutting element C with a sharp cutting edge E, whereas FIG. 12 shows cutting element C with a worn or dull cutting edge E and providing an adjacent wear flat area illustrated at G. Wear flat area G provides rubbing friction against a formation upon rotation of an associated drill bit, thereby generating heat and requiring additional rotational torque for rotation of the associated drill bit. It is noted that with PDC cutters, about fifty percent (50%) of the life of the bit is with worn cutting elements. Therefore, it is highly desirable to have a minimum area in contact with the formation for minimizing rubbing frictional contact with the formation.

Figure 7:
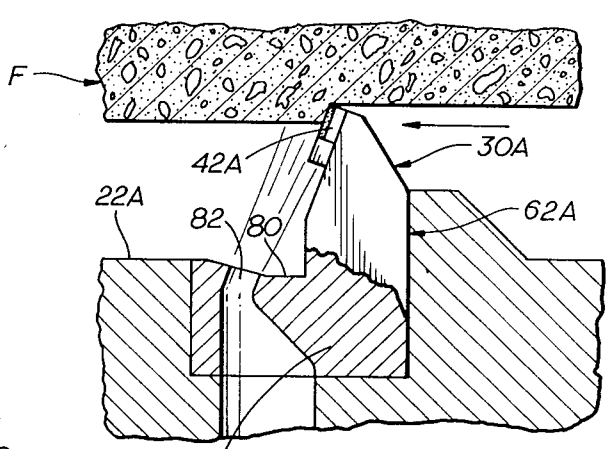
FIG. 7 is a section similar to FIG. 3 of a modified holder for the PDC cutting elements in which the discharge nozzle is mounted within the body of the holder.
Figure 6:
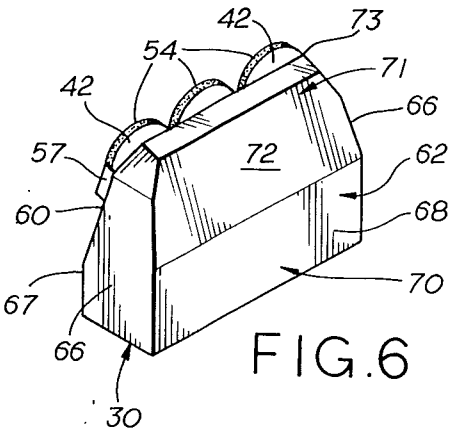
FIG. 6 is a perspective of the holder or support shown in FIG. 5.

Referring now particularly to FIG. 7 in which holder 30A is illustrated, two cutting elements 42A are secured by holder 30A in the same manner as holder 30. However, holder 30A has a body 62A with an enlarged base portion 70 defining an outer surface 80 forming a continuation of adjacent surface 22 of drill bit 10. Surface 80 has an elongate discharge nozzle or opening 82 therein which discharges fluid against the formation in advance of cutting elements 42A and also washes the cutting faces of cutting elements 42A in the same manner as discharge nozzle 74 for holder 30. By incorporating discharge nozzle 82 within holder 62A, a separate discharge nozzle for cutting elements 42A such as nozzle 74 for the embodiment of FIGS. 3–6 is eliminated which simplifies manufacture and assembly.

Holder 30B shown in FIG. 2 is positioned adjacent holder 30A and has three cutting elements 42B therein with a single discharge nozzle or opening 82B formed in body 62B for the discharge of drilling fluid or the like against all three cutting elements 42B and the adjacent formation.

Holder 30C shown in FIG. 2 is similar to holder 30A and has a pair of cutting elements 42C therein with a single discharge nozzle or opening 82C formed in body 62C in a manner similar to discharge nozzle 82 for holder 30A.

Modified holders 30D and 30E shown in FIG. 2 are formed in a manner similar to holder 30 except that holder 30E has only two cutting elements 42E therein. However, a single nozzle 74E is provided having an elongate or oval discharge opening 76E which provides a jet of drilling fluid against all of the cutting elements 42D and 42E for both holders 30D and 30F.

Figure 8:
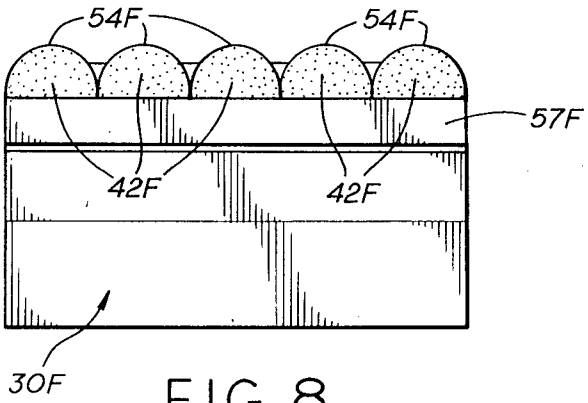
FIG. 8 is a front elevation of a modified holder having a plurality of generally semicircular PDC cutting elements mounted against a lower carbide strip and forming a continuous cutting edge.

FIG. 8 shows a further embodiment of the present invention in which a plurality of PDC cutting elements 42F are positioned on a holder 30F. Cutting elements 42F are of a semicircular shape and each cutting element 42F has a cutting edge 54F thereof to form a generally continuous cutting edge for holder 30F.

Figure 9:
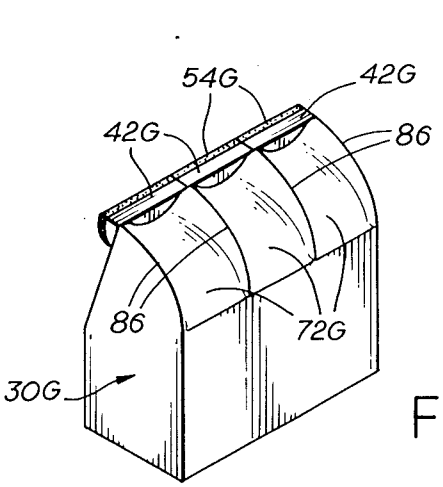
FIG. 9 is a perspective of a modified holder in which a plurality of reinforcing ribs are provided along the back surface thereof to provide reinforcement for permitting a reduced wear surface contact area adjacent the cutting edge.

A further embodiment of the present invention is illustrated in FIG. 9 by holder 30G on which a plurality of ribs 86 are provided on arcuate portion 72G to reinforce the tapered end portion of holder 30G. A linear cutting edge 54G is provided by semicircular cutting elements 42G. Such an arrangement of ribs 86 provides a relatively small wear flat surface adjacent cutting edge 54G upon wear of the associated cutting elements 42G.

Figure 10:
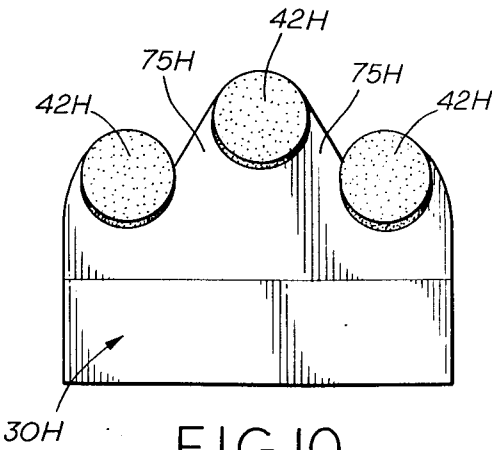
FIG. 10 is a front elevation of a further embodiment of holder in which the PDC cutting elements are arranged at different projecting distances.

Another embodiment of the invention is shown in FIG. 10 in which an integral holder 30H has spaced cutting elements 42H with connecting web portions 75H therebetween. Also, the center cutting element 42H projects beyond the adjacent cutting elements 42H on each side thereof.

It is apparent that various shapes and types of integral holders or mounting means for a plurality of cutting elements may be provided in accordance with the invention. Likewise, a variety of discharge nozzles may be provided in association with the holder and associated cutting elements for providing drilling fluid in advance of the cutting operation to remove cuttings and to cool the cutting elements. By having elongate discharge nozzles, a minimum number of discharge nozzles is required and the elongate openings, by being relatively long, are very difficult to clog with cuttings or the like. A simplified manufacture of holders is also provided by having two or three cutting elements mounted on each holder.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In a drag type rotary drill bit having a bit body defining an exterior face;

at least one unitary integral hard metal holder secured directly to said bit body, said holder being elongate and having a projecting end portion extending from said face of the bit body; and a plurality of polycrystalline diamond compact cutting elements mounted directly on the projecting end portion of said holder, each cutting element having a cutting edge projecting from said holder for engaging in cutting relation, a formation to be cut, each of the cutting edges of the plurality of cutting elements for said holder being in a cutting plane extending generally radially of the axis of rotation of the bit, said holder providing reinforcement and rigidity to said cutting elements in resisting stresses resulting from the cutting operation.

2. In a drag type rotary drill bit as set forth in claim 1 wherein said hard metal holder extends in a direction generally radially of the rotational axis of said drill bit.

3. In a drag type rotary drill bit as set forth in claim 2 wherein said projecting end portion extending from the face of the drill bit has a leading planar surface thereon inclined rearwardly with respect to the rotation of the drill bit, said cutting elements having rear planar faces formed of carbide and secured to said leading planar surface.

4. In a drag type rotary drill bit as set forth in claim 3 wherein said projecting end portion has an inclined trailing surface opposite said planar leading surface, said inclined trailing surface tapering toward the end of the projecting end portion to provide a reduced thickness thereat adjacent the cutting edges of said cutting elements whereby upon wear of the cutting elements a minimal wear flat is provided adjacent said cutting edges to minimize rubbing frictional contact with the formation upon rotation of the drill bit.

5. In a drag type rotary drill bit as set forth in claim 1 wherein the face of said drill bit has a projecting abutment extending in a generally radial direction and having a planar leading surface with respect to the rotation of said drill bit;

said holder having an elongate base portion of a generally rectangular cross section in abutting contact with said projecting abutment and secured thereto.

6. In a drag type rotary drill bit as set forth in claim 1 wherein each of said polycrystalline diamond compact cutting elements has a leading planar cutting face and a trailing rear planar face secured to said holder; said cutting face defining an arcuate cutting edge with said plurality of cutting elements on said holder forming a substantially continuous cutting edge.

7. In a drag type rotary drill bit having a generally cylindrical bit body with a fluid passage therein and adapted to be connected to a drill string for rotation therewith and to receive driling fluid therefrom; an improved cutting means on the outer face of the generally cylindrical bit body comprising:

a solid block-like hard metal support having an elongate base portion secured directly to said drill bit body and extending in a generally radial direction with respect to the axis of rotation, said support having an end portion projecting from the base portion and extending from the outer face of said drill bit body, said projecting end portion having a leading planar face extending generally radially of the axis of rotation of the drill bit; and a plurality of separate polycrystalline diamond compact cutting elements having planar rear faces secured directly to said leading planar face and having cutting edges aligned in a single cutting plane and extending outwardly beyond said projecting end portion, said solid block-like support providing rigidity to said cutting elements in resisting stresses resulting from the cutting operation.

8. In a drag type rotary drill bit having a generally cylindrical bit body with a fluid passage therein and adapted to be connected to a drill string for rotation therewith and to receive drilling fluid therefrom; improved cutting means on the outer face of the generally cylindrical bit body comprising:

a solid block-like support of sintered carbide having a base portion secured to said drill bit body and a projecting end portion extending from the outer face of said drill bit body, said projecting end portion having a leading planar surface inclined rearwardly with respect to the rotation of said drill bit; and a plurality of polycrystalline diamond compact cutting elements each having parallel planar front and rear faces, said front face defining a cutting edge and said rear face defining a mounting face secured to said leading planar surface of said metal support, said plurality of cutting elements arranged in generally side-by-side relation and forming a generally continuous cutting edge in a cutting plane extending generally radially of the axis of rotation of said drill bit.

9. In a drag type rotary dril bit having a bit body with a fluid passage therein leading to an outer face thereof, the bit body connected to a drill string for rotation therewith and to receive drilling fluid therefrom; improved cutting means for said drill bit body comprising:

a solid block-like metal support formed of a tungsten carbide metal having a base portion secured to said drill bit body and an outer projecting end portion extending from said outer face of the drill bit body, said metal support being elongate in a generally radial direction with respect to the axis of rotation of said drill bit and having a planar leading surface on said projecting end portion;

a plurality of cutting elements each having a leading PDC cutting face and a trailing carbide support face with the cutting face defining an outer cutting edge, said carbide support face secured to said leading planar surface of said metal support for securing the associated cutting element thereon, said plurality of cutting elements having their cutting edges extending in a generally radial direction with respect to the axis of rotation of said drill bit; and a fluid discharge nozzle in fluid communication with said fluid passage in said bit body positioned on the bit body in advance of said cutting elements for discharging drilling fluid against the formation to be cut.

10. In a drag type rotary drill bit as set forth in claim 9 wherein said projecting end portion of said metal support has an inclined trailing surface opposite said planar leading surface, said inclined trailing surface tapering toward the end of said projecting end portion to provide a reduced thickness thereat adjacent the cutting edges of said cutting elements whereby upon wear of the PDC cutting elements a minimal wear flat is provided adjacent said cutting edges to minimize frictional contact with the formation upon rotation of the drill bit.

11. In a drag type rotary drill bit as set forth in claim 9 wherein said inclined trailing surface has a clearance angle of at least thirty degrees with respect to the formation being cut.

12. In a drag type rotary drill bit having a bit body with a fluid passage therein leading to an outer face thereof, the bit body connected to a drill string for rotation therewith and to receive drilling fluid therefrom; improved cutting means for said drill bit body comprising:

a solid block-like metal support formed of a tungsten carbide metal having a base portion secured to said drill bit body and an outer projecting end portion extending from said outer face of the drill bit body, said metal support being elongate in a generally radial direction and having a planar leading surface with respect to the rotation of said drill bit; and a plurality of polycrystalline diamond compact cutting elements each having a leading PDC cutting face and a trailing carbide support face with the cutting face defining an outer cutting edge, said support face secured to said leading planar surface of said metal support for securing the associated cutting element thereon, said plurality of cutting elements arranged in generally side-by-side relation and having their cutting edges aligned and extending in a radial direction with respect to the axis of rotation of said drill bit, said projecting end portion of said metal support having an inclined trailing surface opposite said planar leading surface, said inclined trailing surface tapering toward the end of said projecting end portion to provide a reduced thickness thereat adjacent the cutting edges of said cutting elements, the cutting edges of said cutting elements projecting slightly beyond the tapering end of said projecting end portion whereby upon wear of the cutting edges a minimal wear flat surface is provided adjacent said cutting edges to minimize frictional contact with the formation to be cut upon rotation of the drill bit.

13. A drag type rotary drill bit as set forth in claim 12 wherein a projecting abutment is formed on said drill bit body, said abutment extending in a generally radial direction with respect to the axis of rotation and having a planar leading surface;

said base portion of said support having a rear side thereof in abutting contact with said projecting abutment and secured thereto.

* * * * *